United States Patent [19]

Yamamoto et al.

[11] Patent Number: 4,972,573

[45] Date of Patent: Nov. 27, 1990

[54] METHOD OF MANUFACTURING WOUND TRANSFORMER CORES

[75] Inventors: Yasuo Yamamoto; Katsumi Hanaoka; Masatake Hirai; Nobuyuki Sumida; Masatake Kokado, all of Osaka, Japan

[73] Assignee: Daihen Corporation, Osaka, Japan

[21] Appl. No.: 385,694

[22] Filed: Jul. 26, 1989

[30] Foreign Application Priority Data

Mar. 2, 1989 [JP] Japan ..... 64-50751
Apr. 12, 1989 [JP] Japan ..... 64-92297

[51] Int. Cl.[5] ..... H01F 41/06

[52] U.S. Cl. ..... 29/609; 336/213; 336/217; 336/234

[58] Field of Search ..... 29/605, 606, 609; 336/212, 213, 216, 217, 234

[56] References Cited

U.S. PATENT DOCUMENTS 4,646,048 2/1987 Hunt et al. .
4,709,471 12/1987 Valencic et al. ..... 29/605
4,734,975 4/1988 Ballard et al. .
4,741,096 5/1988 Lee et al. .
4,761,630 8/1988 Grimes et al. .
4,789,849 12/1988 Ballard et al. .

*Primary Examiner*—Carl E. Hall
*Attorney, Agent, or Firm*—Scully, Scott, Murphy & Presser

[57] ABSTRACT

A method for manufacturing rectangular wound cores including a step of forming at least one developed lamination body by cutting off at least one ring-like lamination body, a step for applying adhesive agent to one of cut ends of each developed lamination body, a step forming lamination blocks each of which is comprised of plural lamination units shifted in the length-wise direction by a predetermined distance and a step for jointing both ends of each of lamination unit in an overlapping state by winding each lamination block around a shaping bobbin.

9 Claims, 8 Drawing Sheets

METHOD OF MANUFACTURING WOUND TRANSFORMER CORES

BACKGROUND OF THE INVENTION

1. Field of the Invention

The present invention relates to a method for manufacturing transformer cores wound from a strip of amorphous magnetic alloy.

2. Description of the Related Art

Recently, amorphous magnetic alloys have attracted attention as core materials because of low magnetic loss and methods for manufacturing distribution transformers using a strip of amorphous magnetic alloy have been studied.

Conventionally, cores for distribution transformers are made using silicon iron strips. According to a conventional manufacturing method, laminations each of which is comprised of plural silicon iron strip elements having been cut so as to have a length slightly larger than that of one turn are prepared and bent into a rectangular configuration. Then, plural laminations are packaged into a lamination block by abutting the ends of each of laminations stepwise. Further, plural lamination blocks are built into a core. This type of core is called a core of one turn cut.

Upon manufacturing the core of one turn cut type, a wound silicon iron strip is cut with a length slightly longer than that of one turn while unwinding the wound strip. The cut strip elements are wound successively so as to form a circular core by staggering the joint position thereof to that of the foregoing one. The core thus formed is shaped into a rectangular configuration and, thereafter, annealed. Then, the core is opened once to windings thereinto and, thereafter, the core is close by jointing respective joints to build into a transformer.

An applicability of this manufacturing method for the manufacture of cores using amorphous magnetic strip was studied at first. However, the amorphous magnetic strip is difficult to handle since it has a thickness of about 25 μms which demands a laborsome and inefficient cutting operation.

In order to solve these problems, there has been proposed a method wherein lamination units are formed by laminating plural strip elements (ten to several tens element and a core is formed using plural lamination units. According to this method, plural lamination units are stacked and the stacked units are wound to form a lamination block by lapping both ends of each of the units shifted with each other in stairstep fashion and plural lamination blocks thus formed are built to a core having a predetermined thickness.

In this conventional method, the strip is wound around a mandrel having a length one the outer periphery thereof longer than that of the inner periphery of the core to be formed (usually longer by several tens mms). Then, the strip wound around the mandrel is cut off at a predetermined position thereof to obtain a lamination unrolled linearly. Then, lamination units are formed by separating plural strip elements so as to have a predetermined thickness, respectively.

In this method, it is necessary to give a sufficient lapping length at each joint in order to obtain a desirable magnetic property of the core. Upon building the transformer using cores, respective joints of the core are opened once after annealing it and the opened core is inserted from a window of the transformer and, thereafter, respective joints are joined again. If the lapping amount of each joint is too short, it becomes difficult to join respective opened joints again. Due to these reasons, it becomes necessary to guarantee the lapping amount of about six times the thickness of the lamination unit at respective joints.

In the core formed according to the lapping joint method, the thickness at each lapped joint becomes larger than those of other portions of the core and the amount of increase of the thickness becomes large in the radially outward direction of the core. Due to this, the length of outer periphery of the core is increased and, on the contrary, the lapping amount at each joint is decreased thereby.

According to the conventional manufacturing method wherein individual cores are formed using plural lamination units each of which is comprised of plural strip elements, the strip elements of the inner lamination block can be lapped a lapping amount slightly smaller than the increase of the inner periphery of the inner lamination relative to that of the core.

However, in this conventional method, it is impossible to guarantee a sufficient lapping amount at outside joints because of the increasing radius at the respective joints. If the lapping amount at the inner joint is set beforehand at a value fairly larger than that necessary for the inner joint, it becomes possible to guarantee the necessary lapping amount at the outer joint. However, this necessitates much more volume of the amorphous magnetic material and is uneconomical.

SUMMARY OF THE INVENTION

A primary object of the present invention is to improve a method for manufacturing transformer cores wherein lamination units are formed by laminating cut strips of an amorphous magnetic alloy, lamination blocks are formed by stacking up plural lamination units and a rectangular wound core is formed by jointing respective ends of individual lamination units belonging to each of lamination blocks in an overlapped state.

Another object of the present invention is to provide a manufacturing method of transformer cores which is capable of improving the efficiency of work by preventing lamination blocks from collapsing upon taking out respective lamination units from each of the lamination blocks.

A further object of the present invention is to provide a manufacturing method of transformed cores which is capable of guaranteeing enough lap length between adjacent lamination units at respective joint sections.

In order to achieve these objects, according to the present invention, there is provided a method for manufacturing rectangular wound cores wherein plural lamination blocks are formed respectively, by laminating plural lamination units each of which is formed by laminating a predetermined number of cut strips of an amorphous magnetic alloy and said plural lamination blocks are built up to a substantially rectangular wound core by stacking and by jointing respective ends of individual lamination units of each lamination block in an overlapped state being characterized by the following steps;

a step for forming at least one developed lamination body by cutting off at least one ring-like lamination body at a position thereof in a radial direction which is formed by winding a strip of an amorphous magnetic alloy around a substantially circular bobbin, a step for applying adhesive agent to one of the cut ends of said at least one developed lamination body, a step for forming said lamination blocks by separating said at least one developed lamination into said plural lamination units and by shifting them in the lengthwise direction by a predetermined distance, and a step for jointing both ends of each of said lamination units belonging to one of said plural lamination blocks in an overlapped state by winding each lamination block around a bobbin for shaping said plural lamination blocks by winding them therearound in the order from the shortest one to the longest one wherein each of said plural lamination blocks is wound up form the cut end side to which the adhesive agent has been applied.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENT

Figure 1:
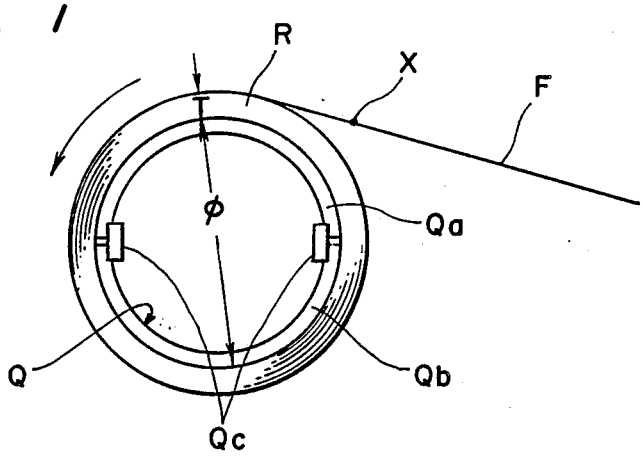
FIG. 1 is a front view of a ring-like lamination wound around a circular bobbin.

FIG. 1 shows a ring-like lamination R obtained by winding a strip F of amorphous magnetic metal around a circular bobbin Q.

The circular bobbin Q shown in FIG. 1 is comprised of two semicylindrical members Qa and Qb and two joint tools Qc for coupling the semicylindrical members Qa and Qb so as to form the circular bobbin Q having a diameter of $\phi$. Each of the ends of these semicylindrical members Qa and Qb is fixed to each of the joint tools Qc using bolts (not shown).

As is well known to those skilled in the art, the circular bobbin Q is driven by an expandable mandrel (not shown).

When the winding operation is completed, the strip F is cut at a point X and the cut end of the ring-like lamination R is adhered thereto using an adhesive tape (not shown). Then, the mandrel is drawn out of the bobbin Q after contracting the mandrel. Thereafter, two joint tools Qc are removed by loosing respective bolts. When they are removed, gaps between two semicylindrical members Qa and Qb are closed to allow the ring-like lamination R to draw out of the bobbin Q.

The ring-like lamination R is cut at a position in a radial direction thereof to open the same. The opened lamination Q is divided into plural lamination units each of which is comprised of a predetermined number of cut strips and these lamination units are packaged into plural lamination blocks each of which is comprised of a predetermined number of lamination units. These plural lamination blocks are wound around a bobbin of a substantially rectangular shape successively and each end of a lamination unit belonging to a lamination block is joined with another end of the lamination unit adjacent thereto in an overlapped fashion and, thereby, a core is manufactured.

In this manufacturing process, it is important to make a lapping dimension at each joint between two adjacent lamination units larger than a predetermined lower limit $\Delta L_{min}$ in order to guarantee enough magnetic flux flow therebetween. In order to satisfy the above condition, the thickness T of the wound ring-like lamination R must be limited equal to or smaller than a predetermined upper limit Tmax. The upper limit Tmax is not determined uniquely since it depends on the width of a window of a core (an inner distance between both of leg portions of the core) and it increases as the width increases. Usually, the thickness T of the lamination Q is set at a value between one half of Tmax and Tmax (namely $\frac{1}{2}\,T_{max} < T \leqq T_{max}$).

The strip F of amorphous magnetic material available at present has a thickness of about 25 $\mu$ms. The width thereof is about 150 mms in the case of the distribution transformer having a capacity of about 20 kVA. The maximum width of this type strip now available industrially is about 200 mms while much wider silicon iron strips are marketed.

The magnetic flux density applicable to the strip of amorphous magnetic metal to be used for the distribution transformer for the commercial power supply is about three quarters of that applicable to the silicon iron plate used for the same.

Due to these facts, the thickness of the core made from the strip of amorphous magnetic metal tends to be thicker than that of the core made from the silicon iron strip if both of them have an identical power. This tendency becomes more clear as a higher power of the transformer is required.

If the thickness Tc of the wound core is smaller than the upper limit Tmax, it is easy to guarantee a desirable lapping dimension larger than the lower limit ΔLmin. However, if the thickness Tc of the wound core is required to be larger than the upper limit Tmax of the ringlike lamination, it becomes necessary to prepare first to n-th (n is an integer larger than one) laminations having increasing winding radii respectively in order to limit the thickness of each lamination equal to or smaller than Tmax.

Upon making the first to n-th laminations using first to n-th circular bobbins with increasing radii, the radius of the first bobbin is determined so as for the peripheral length thereof to become larger than the length of inner periphery of the core of a rectangular shape by a predetermined length. Similarly, each of the outer peripheral lengths of the second to n-th bobbins is set so as to be larger than each of the inner peripheral lengths of the first to (n−1)−th cores by a predetermined length.

Usually, the core is manufactured using plural laminations. In the case shown in FIG. 2, three ring-like laminations R1 to R3 are formed using three circular bobbins Q1 to Q3 having diameters $\phi 1$ to $\phi 3$ ($\phi 1 < \phi 2 < \phi 3$), respectively.

In the present preferred embodiment, the winding thickness Tc of the core C is set at 120 mms, each of winding thicknesses T1 to T3 of the ring-like laminations R1 to R3 is set at 40 mms and the lower limit ΔLmin of lamination is set at 6 mms.

It is to be noted that the winding thickness Tc of the core C indicates a winding thickness of a portion of the core at which no joint between adjacent lamination units is formed which contributes to increase the winding thickness of the core. Further, unless mentioned specifically, the space factor of each ring-like lamination R is assumed to be equal to that of the core.

Diameters $\phi 1$ to $\phi 3$ of the first to third circular bobbins Q1 to Q3 are determined according to the following equations.

$$\phi 1 = (Lci + \Delta Ls + \alpha)/\pi \quad (1)$$

$$\phi 2 = \phi 1 + 2T1 + \beta 2 \quad (2)$$

$$\phi 3 = \phi 2 + 2T2 + \beta 3 \quad (3)$$

wherein Lci, ΔLs, $\alpha$, $\beta 2$ and $\beta 3$ are determined as follow:

Lci : the length of inner periphery of the core C

Figure 6:
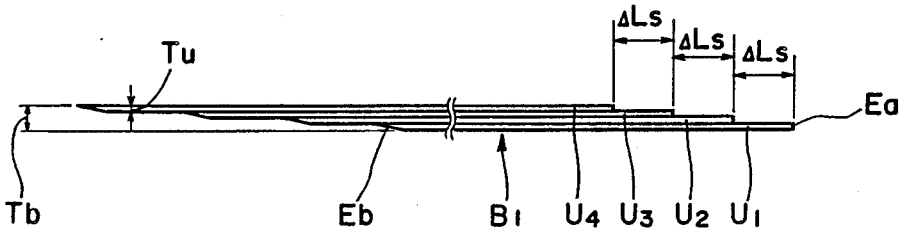
FIG. 6 is a front view of a lamination block formed by stacking unit laminations up.

ΔLs : the standard shift length between adjacent lamination units as defined in FIG. 6 (it is desirably set at a value between several mms to 20 mms)

$\alpha$: the width of cut of the ring-like lamination (which is determined by a width of a blade edge of a cutting tool for cutting the ring-like lamination and is an order of several mms)

$\beta 2$, $\beta 3$ : the room dimensions for the diameters of the ring-like laminations (each of which is to be determined experientially in accordance with the winding thickness. Several mms is proper for a normal winding thicknes). Only $\beta$ without any suffix indicate the room dimension of the diameter generally.

Also, according to the assumption with respect to the space factor, the following equation is satisfied;

$$Tc = T_1 + T_2 + T_3 \quad \ldots (4)$$

Figure 2:
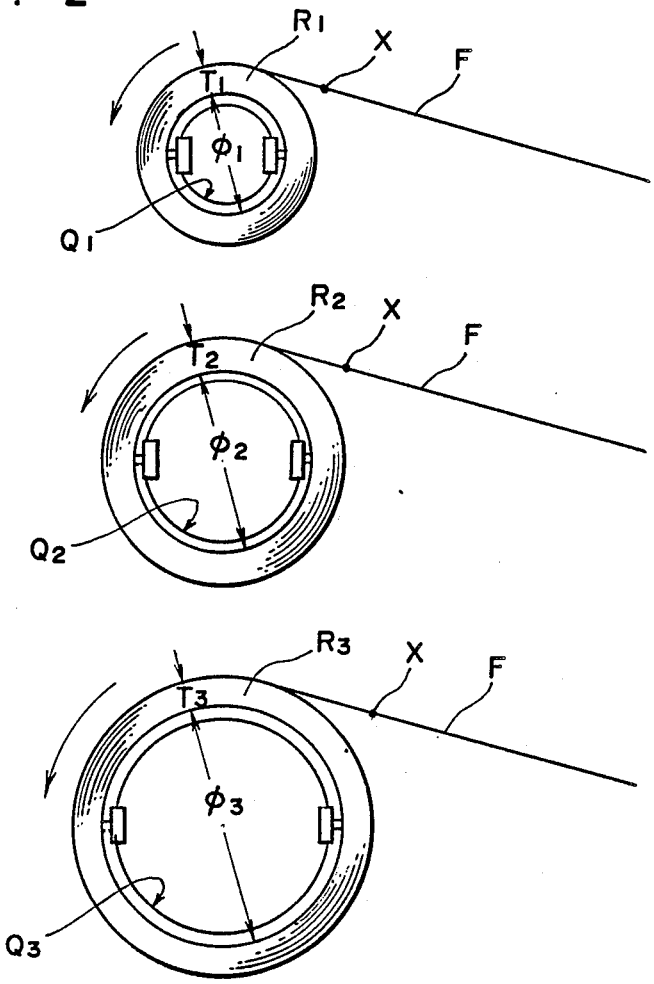
FIG. 2 shows three ring-like laminations wound around respective circular bobbins having different diameters.

FIG. 2 shows completed states of winding operations for the first to third ring-like laminations R1 to R3. They are drawn out of respective bobbins Q1 to Q3 in a manner as explained with respect to FIG. 1.

Figure 3:
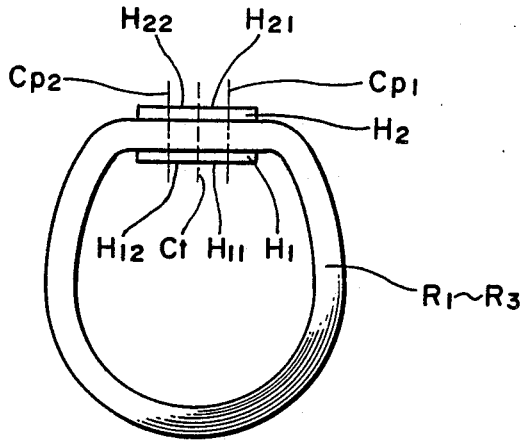
FIG. 3 is a front view showing a state of a ringlike lamination held by a pair of holding plates.

Each of the ring-like laminations drawn out is clamped by a squill vise (not shown) after placing a pair of holding plates H1 and H2 so as to put a portion thereof between them in a radial direction thereof. In FIG. 3, positions indicated by chain lines $Cp_1$ and $Cp_2$ represent clamp positions by the squill vise, which are respectively selected at the center positions when seen in the direction of width of the ring-like lamination R.

After clamping the ring-like lamination R, it is cut at a center position of the holding plates H1 and H2 indicated by a chain line Ct in the radial direction together with the holding plates H1 and H2. The width of cutting is indicated by $\alpha$. As the result, the holding plates H1 and H2 are also cut into halves H11, H12, H21 and H22, respectively.

After cutting each of the first to third ring-like laminations R1 to R3, one end thereof is kept in the clamped state while the other end is released by unclamping one-half of the squill vise and the halves H12 and H22 of respective holding plates H1 and H2 are removed.

Figure 4:
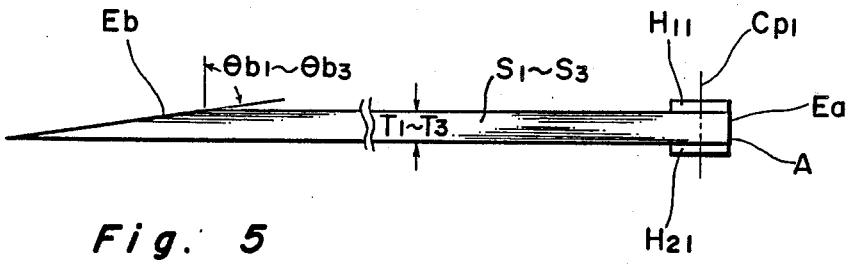
FIG. 4 is a front view of a lamination developed by cutting the ring-like lamination.

Thereafter, each of the first to third ring-like laminations R1 to R3 is extended in a straight line to form each of developed laminations S1 to S3 while clamping one end thereof, as shown in FIG. 4. The process from the state of FIG. 3 to that of FIG. 4 is defined as the step for forming the developed laminations.

As shown in FIG. 4, the cut face Ea of the clamped end of each of the developed laminations S1 to S3 is held perpendicularly to the length-wise direction thereof while the other cut end Eb thereof forms a plane inclined to the length-wise direction thereof.

Let us define taper angles $\theta a$ and $\theta b$ of the cut faces Ea and Eb which make to the plane perpendicular to the length-wise direction of the developed lamination, respectively.

According to the definition of the taper angle, the following relations among taper angles $\theta a1$ to $\theta a3$ and $\theta b1$ to $\theta b3$ of respective cut faces of the developed laminations S1 to S3 are easily obtained:

$$\theta a1 = \theta a2 = \theta a3 = 0^\circ$$

$$\theta b1 = \theta b2 = \theta b3 = \tan^{-1} 2\pi \approx 81^\circ$$

After forming the developed laminations S1 to S3, an adhesive agent is applied to each of cut faces Ea of them. An adhesive agent of a solvent volatile type is desirably used. In the present preferred embodiment, Plio bond® offered by the Ashland Chemical Company is used after diluting it with a suitable solvent.

Figure 5:
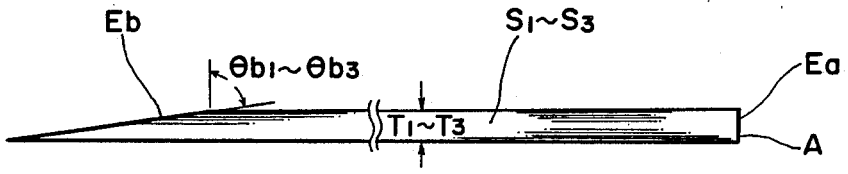
FIG. 5 is a front view of the developed lamination from which the pair of the holding plates have been removed.

The applied adhesive agent is dried in air for several minutes to form a membrane as indicated by A in FIG. 5. The membrane is omitted in other FIGS. except for FIGS. 4 and 5.

When the applied membrane A is dried properly, the halves H11 and H21 of the holding plates 11 and 12 are removed as shown in FIG. 5.

In this state, respective strips F forming each of the developed laminations S1 to S3 are held by the adhesive force of the membrane A so as not to shift relative to each other after removing the clamp force.

Thereafter, each of the developed laminations S1 to S3 is divided into plural lamination units U1 to U4, as shown schematically in FIG. 6, by separating every predetermined number of strips F so as to have a proper thickness. The thickness Tu of each lamination unit U is desirably set at a value ranging from 0.3 mms to 1 mm. If it is set at 1 mm, the number Nfu of strips forming each lamination unit U is forty since the thickness Tf of each strip is 25 μms (namely, Nfu=Tu / Tf=1 / 0.025=40). However, the actual number Nfu fluctuates between a certain range since the actual space factor is smaller than one (100%) and therefore it is difficult to make the thickness Tu constant. The separating operation for the lamination unit can be done by inserting a knife edge of a tool (not shown) between adjacent strips F so as to make them free from the adhesive force provided by the membrane A.

Assuming that the thickness Tu of the lamination unit U is 1 mm, the total number Nu of the lamination units obtained from the developed laminations S1 to S3 is 120. These lamination units are indicated by suffixed capital letters $U_1$ to $U_{120}$ which are assigned in an order of increase with respect to the length of the unit.

Next, lamination blocks are formed using these lamination units. Assuming the number of lamination units included in one of these lamination blocks is Nub, the upper limit of Nub is determined in accordance with the width of the window of the core. As is easily understood, Nub can be increased as the width of the window becomes larger.

In the example shown in FIG. 6, one lamination block $B_1$ is constituted from four lamination units U1 to U4 (Nub=4). Accordingly, the total number Nb of the lamination blocks used for constituting the core C is thirty. In general, the total number Nb is given according to an equation Nb=Nu / Nub, as is easily understood.

Thus, thirty lamination blocks B1 to B30 are constituted using every four lamination units U1 to U4, U5 to U8, . . . ,U117 to U120. In the preferred embodiment, the thickness Tb of each lamination block becomes 4 mms since it is given by an equation Tb=Nub * Tu in general.

Each lamination block is built up by piling respective lamination units one by one from the shortest one on a level block (not shown) in a manner shifted by a predetermined standard shift length ΔLs in the length-wise direction of the lamination block at the side of the cut face Ea.

In the present preferred embodiment, the standard shift length ΔLs is desirably set at 15 mms.

The process for forming the lamination block is explained more concretely referring to FIG. 6 which shows a structure of the first lamination block B1.

At first, the shortest lamination unit U1 is put on the level plate so as for the shortest strip to face thereto. Then, the second unit U2 is laid on the first unit U1 facing the shorter side thereof downwardly. Upon being laid down, the second unit U2 is shifted from the adhered end of the first unit U1 by the standard shift length ΔLs in the length-wise direction thereof.

Similarly, the third and fourth units U3 and U4 are laid respectively to form the lamination block B1 finally.

The lamination blocks from B2 to B30 are built up in the same manner as the first one.

After the process for forming the lamination blocks, a process for joining these lamination blocks is performed using a bobbin prepared for winding respective lamination blocks. These blocks are wound one by one from the shorter side with respect to the length of the block. Each block is wound from the leading end thereof which is defined as the end shifted by the standard shift length ΔLs between adjacent units. Other ends of respective lamination units are joined overlapped with respective leading ends of them in such a manner that the leading end of each unit is overlapped with the trailing end of the same.

Figure 7:
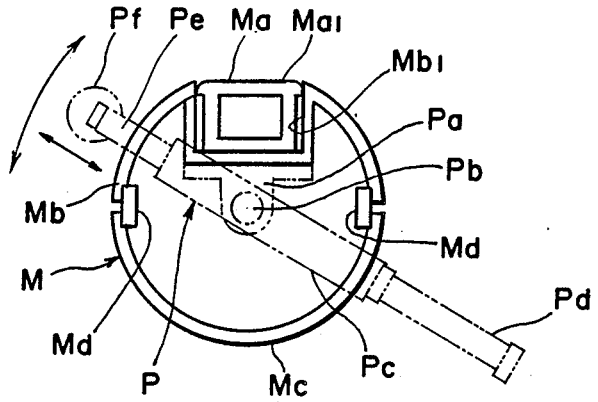
FIG. 7 is a plan view showing a bobbin for winding the lamination block therearound and a winding apparatus therefor.

FIG. 7 shows the bobbin M to be used for winding the lamination blocks.

The bobbin M is substantially comprised of a first semicircular member Mb, a second semicircular member Mc and a shaping tool Ma of a square configuration for defining a joint section of the lamination block which is fitted in a square indent Mb1 formed in the first semicircular member Mb. The first and second semicircular members Mb and Mc are connected to each other by joints Md and Md so as to build up the bobbin M. Each joint is tied to respective ends of the first and second semicircular members Mb and Mc by bolts (not shown). The shaping tool Ma is not fixed in the dent Mb1 so as to be able to separate it from the first semicircular member Mb.

The bobbin M is arranged on a horizontal level block (not shown) so as for the axis thereof to be perpendicular to the level block and is fixed unrotatably by plural pins projected therefrom each of which is fitted into corresponding hole provided on the bobbin M.

This bobbin M has a configuration symmetric with respect to the center line of the shaping tool Ma having a flat outer surface Mal. This surface Mal is positioned corresponding to a position of a side of a core window at a york side thereof and has a length equal to the side of the core window.

Further, the total outer peripheral length of the bobbin M is set equal to the inner peripheral length Lci of the wound core.

Assuming that the diameter of the bobbin M is $\phi m$, and the length of the flat surface Mal of the shaping tool Ma is kLci, the following equation is obtained from a geometrical relation of the bobbin M;

$$\pi\phi m\,[1-(1/180)\sin^{-1}(kLci/\phi m)]=Lci\,(1-k)$$

Though k can have a value which falls in a range defined between 0 and 0.5 in view of the geometrical relation, it is limited to a narrower range actually.

Since the width of the core is usually smaller than but not extremely smaller than the height of the window thereof (the dimension of the window orthogonal to the width of the window), the actual value of k falls in the range defined between 0.1 and 0.25. Assuming k=0.2, the diameter $\phi m$ of the bobbin M is given by 0.323 Lci.

It is to be noted that the shaping tool Ma is formed to have rounded portions at both ends of the flat portion Mal thereof in order to guarantee to smooth winding and shaping operation.

A winding apparatus P is provided for winding the lamination blocks B around the bobbin M as shown in FIG. 7.

The winding apparatus P provides a rotation axis Pb rotatably supported by a bearing member Pa which is fixed to the bottom wall of the indent Mb1 and, an arm Pc extending in a radial direction of the bobbin M is fixed to the rotation axis Pb, so as to rotate around the center of the bobbin M. An air cylinder Pd is mounted on one end of the arm Pc and a rod Pe driven by the air cylinder Pd is protruded from the other end of the arm Pc passing through the same. A press roller Pf is supported at a free end of the rod Pe. The length of the press roller Pf is set to have a value substantially equal to the width Wf of the strip F.

Upon winding respective lamination blocks around the bobbin M, the air cylinder Pd is energized so as to press the leading end of the lamination block toward the center of the bobbin M by the press roller Pf. Thereafter, the arm Pc is operated manually or by a suitable driving means to rotate about the rotation axis Pb. The lamination block is wound around the bobbin M or the preceding lamination block having been wound while pressing the same by the press roller Pf with a constant press force.

Figure 8:
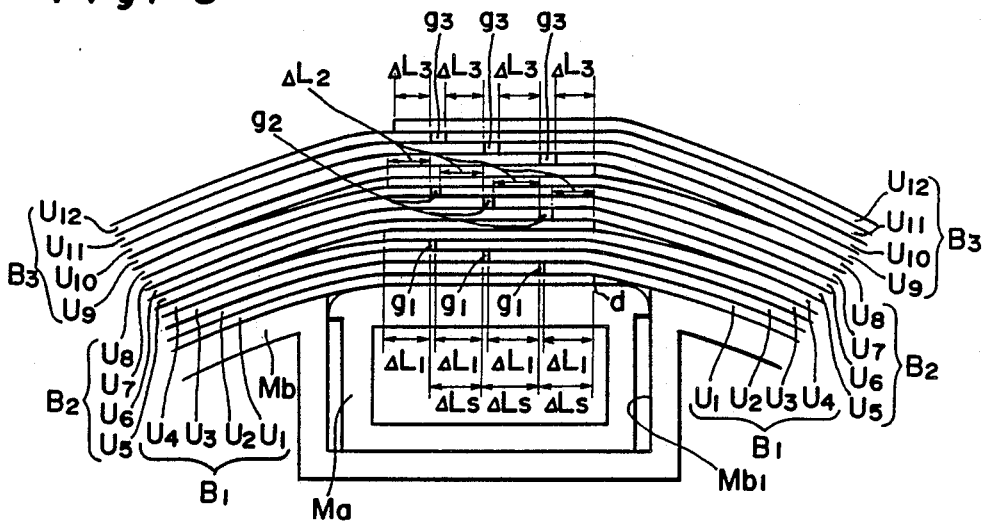
FIG. 8 is an enlarged partial view of a joint section of the lamination block wound around the bobbin shown in FIG. 7.

FIG. 8 is an enlarged side view of the joint portion of the lamination blocks and shows a state wherein the first to third lamination blocks B1 to B3 have been wound.

At first, the first lamination block B1 comprised of the lamination units U1 to U4 is wound around the bobbin M. Upon winding it, the leading end of the first lamination unit U1 being the inner-most unit is set at a predetermined position d on the flat portion Mal of the shaping tool Ma which is set near one end thereof. Then, the arm Pc of the winding apparatus P is rotated in the anti-clockwise direction and, therefore, the first block B1 is wound around the bobbin Ma in the order of the other end of the shaping tool M, the left side portion of the first semicircular member Mb, the left side portion of the second semicircular member Mc, the right side portion of the second semicircular member Mc, the right side portion of the first semicircular member Mb and the one end of the shaping tool Ma. Thus, the trailing ends of the first to fourth lamination units U1 to U4 are piled on the leading ends of them in a lapped fashion. Namely, each trailing end is overlapped with to each leading end of the same lamination unit to form a stepping joint. In this winding process, each of the strips forming the lamination unit can slide relatively with each other since it is free from binding force at the trailing end side thereof. After the lamination units U1 to U4 have been wound, each of trailing ends has an end face vertical to the direction of winding. Namely, it has a taper angle of zero degree although it has a taper angle $\theta b$ of 81° in the developed state of the lamination block. Needless to say, the taper angle $\theta a$ of the leading end of each lamination unit is zero regardless of the winding operation.

The position d at which the leading end of the first lamination unit is positioned is determined experientially for performing the winding operation smoothly. Generally, it depends on the thickness Tu of the lamination unit and is set at the inner side of the flat portion Mal of the shaping tool Ma as the thickness Tu increases.

During the winding operation of the lamination block, individual strips receive extension forces applied in the winding direction. However, no shifts are caused among strips because of the adhesion force by the adhesive agent applied to the leading end provided that the press force by the air cylinder Pd is kept properly.

As is apparent from FIG. 8, the thickness of lamination in the joint area of the wound lamination block B1 becomes larger than the thickness Tb of the other area thereof by the thickness Tu of the lamination unit. Accordingly, the total peripheral length of the lamination block B1 wound in a lapped fashion becomes slightly larger than that of the wound lamination block assumed to have a uniform thickness equal to the thickness Tb all around the lamination block.

Due to this fact, the lapping dimension $\Delta L_1$ between the leading and trailing ends of the lamination unit becomes smaller than the standard shift length $\Delta Ls$ by a small amount $\Delta Lg_1$ (the length of the gap $g_1$), as shown in FIG. 8.

In the present embodiment, all of the lapping dimensions of the lamination units belonging to the same lamination block are deemed equal to each other.

After winding the first lamination block B1 around the bobbin M, the leading end of the first lamination unit U5 of the second lamination block B2 is set at a position on the first block B1 corresponding to the position d. Thereafter, the second lamination block B2 is wound around the first one having been wound similarly in the case of the latter. The lapped dimension between adjacent lamination units is assumed to be $\Delta L2$.

Because of increases in the total peripheral lengths of the wound lamination blocks due to the overlapping winding, the lapped dimension $\Delta L_2$ of the second lamination block B2 becomes smaller than that ($\Delta L1$) of the first one.

As is easily inferred from the analogy mentioned above, lapped dimensions $\Delta L1$ to $\Delta L10$ of the first to tenth lamination blocks decrease stepwisely as the winding radius becomes larger. Namely, $\Delta Ls > \Delta L1 > \Delta L2 > \ldots > \Delta L9 > \Delta L10$.

In order for later consideration, there is introduced an amount $\epsilon$ called "difference between the lapping dimensions" which is defined as a difference between the lapping dimensions of the adjacent lamination blocks belonging to a developed lamination. The difference $\epsilon$ between the lapping dimension is assumed to be constant regardless of the order of the lamination block.

Namely, with respect to the first to tenth lamination blocks B1 to B10 obtained from the first developed lamination S1, the following relation is satisfied.

$$\begin{aligned} 2(\Delta Ls - \Delta L1) &= \Delta L1 - \Delta L2 \\ &= \ldots = \Delta L8 - \Delta L9 \\ &= \Delta L9 - \Delta L10 = \epsilon \end{aligned} \tag{5}$$

The reason why the difference ($\Delta Ls - \Delta L_1$) is set at one half of $\epsilon$ while each of other ($\Delta Ls - \Delta L_2$), . . . , ($\Delta L_9 - \Delta L_{10}$) is set at $\epsilon$ is that the first lamination block $B_1$ has only one triangular gap at one side of the joint area thereof while other lamination blocks have triangular gaps at both sides of the joint area, respectively.

From the equation (5), the next equation is obtained as follows:

$$\begin{aligned} \Delta L10 &= \Delta L9 - \epsilon \\ &= \Delta L8 - 2\epsilon \\ &= \ldots = \Delta L1 - 9\epsilon \\ &= \Delta Ls - 9.5\epsilon \end{aligned} \tag{6}$$

Assuming $\Delta Ls = 15$ mms, $\epsilon = 0.9$ mms, $\Delta L10$ decreases to 6.45 mms which is about 40% of $\Delta L1$ (= 14.55 mms).

The lamination blocks from B11 to B20 are formed from the second developed lamination S2.

Assuming $\beta 2 = 0$ in the equation (2), the lengths of the lamination blocks B11 to B20 become equal to those formed from a developed lamination obtained by winding the strip F around the first ring-like lamination R1 having been wound around the bobbin Q1 until the second ring-like lamination R2 has the thickness of winding equal to T2. In this case, the same relation given by the equation (6) is applied. Namely, $\Delta L11 = \Delta L10 - \epsilon$, for example.

However, since the diameter $\phi_2$ of the second circular bobbin $Q_2$ is represented by the equation $\phi_2 = \phi_1 + 2T1 + \beta 2$ ($\beta 2 \neq 0$) in practice, the equation (6) cannot be applied directly to the lamination blocks formed from the second ring-like lamination R2 wound around the second circular bobbin $Q_2$. In other words, each of the actual lamination blocks becomes longer than each of the lamination blocks formed from the ring-like lamination directly wound around the first ring-like lamination by $\pi\beta 2$.

Accordingly, the lapping dimension ΔL11 becomes equal to ($\Delta L10 - \epsilon + \pi\beta 2$) and, assuming $\pi\beta 2 = 10\epsilon = 9$ mms, ΔL11 is equal to 14.55 mms which is equal to ΔL1 (=14.55 mms).

With respect to the lapping dimentions ΔL11 to ΔL20 of the lamination blocks, the following relation is obtained similarly to the equation (6);

$$\begin{aligned} \Delta L20 &= \Delta L19 - \epsilon \\ &= \Delta L18 - 2\epsilon \\ &= \ldots = \Delta L11 - 9\epsilon \end{aligned} \quad (7)$$

Namely, each lapping dimension decreases by $\epsilon$ from the inner lapping dimension and the outermost one ΔL20 becomes equal to 6.45 mms (=14.55−9 ·0.9).

As is apparent from the above, the lapping dimension increases at the innermost lamination block B11 discontinuously from the outer-most lamination block B10 belonging to the first developed lamination and decreases successively as it goes from the innermost side to the outermost side.

Lamination blocks B21 to B30 are formed from the third developed lamination S3 obtained from the third ring-like lamination R3 having been wound around the third circular bobbin Q3 having a diameter $\phi_3 = \phi 2 + 2T2 + \beta 3$.

If $\beta 3$ is assumed to be zero in the equation (3), the equation (7) is applicable to ΔL21 to ΔL30 extrapolatedly. However, since $\beta 3$ is not equal to zero in fact, it is not directly applicable.

The following relation is obtained regarding the lapping dimensions ΔL21 to ΔL30 of the lamination blocks B21 to B30 similarly to the equation (7);

$$\begin{aligned} \Delta L30 &= \Delta L29 - \epsilon \\ &= \Delta L28 - 2\epsilon \\ &= \ldots = \Delta L21 - 9\epsilon \\ \Delta L21 &= \Delta L20 - \epsilon + \pi\beta^3 \end{aligned} \quad (8)$$

Assuming $\pi\beta 3 = 10\epsilon = 9$ mms, ΔL21 is 14.55 mms which is equal to ΔL11 (=14.55 mms) and ΔL30 becomes 6.45 mms (=14.55−9 * 0.9).

Next, the room dimension $\beta$ of diameter is considered generally.

Assuming that the room dimension of diameter regarding j-th circular winding bobbin Qj ($2 \leqq j \leqq n$) is given by $\beta j$ and the member of lamination blocks formed from the ring-like lamination having been wound around (j−1)th circular winding bobbin Qj−1 is given by N(j−1)b, it is given by an equation as follows;

$$\beta j = N(j-1)b \cdot \epsilon / \pi \ldots \quad (9)$$

If $N_1b = N_2b = 10$ and $\epsilon = 0.9$ mm, $B_2 = B_3 = 10 \cdot 0.9 / \pi \approx 2.9$ mms.

When the room dimension of the diameter is set according to the equation (9), the lapping dimension regarding the first lamination block becomes constant through all of the ring-like laminations wound around individual circular bobbins $Q_1$ to $Q_n$. It is to be noted that the equation (9) is given only as a standard rule and the room dimension of diameter is not necessarily set according thereto.

The thickness of lamination at the circular portion of the core having been wound around the bobbin M is given by the equation (4); namely $$\begin{aligned} Tc &= T_1 + T_2 + T_3 \\ &= 40 + 40 + 40 = 120 \text{ mms.} \end{aligned} \quad \ldots (10)$$

However, the thickness Tcl of lamination of at the joint portion of the core corresponding to the shaping tool Ma becomes larger than Tc by a product of the thickness of the lamination unit with the total number Nb of the lamination blocks. Namely, Tcl=120+10 · 3=150 mms. In general, $$Tcl = Tc + Tu \cdot Nb$$

In FIG. 8, g1, g2 and g3, called the gap g generally, denote respective gaps formed between the leading end and the trailing end of the adjacent lamination units in the joint section of the wound core.

The length of the gap g is indicated by ΔLg and, accordingly, lengths of the gaps $g_1$, $g_2$ and $g_3$ are indicated by $\Delta Lg_1$, $\Delta Lg_2$ and $\Delta Lg_3$. As is apparent from the definitions of ΔLs, ΔLi and ΔLgi of i-th lamination block Bi, the next relation is satisfied;

$$\Delta Ls = \Delta Li + \Delta Lgi \quad \ldots (11)$$

With respect to the lamination blocks B1 to B10 obtained from the first developed lamination S1, the following equation is obtained from the equations (6) and (11);

$$\Delta Lgi = (i - 0.5)\,\epsilon \quad \ldots (12)$$

As is apparent from the equation (11), the lapping dimension ΔLi and the length ΔLgi of gap gi have such a relation that an increase of the former invites a decrease of the latter and a decrease of the former invites an increase of the latter.

Figure 9:
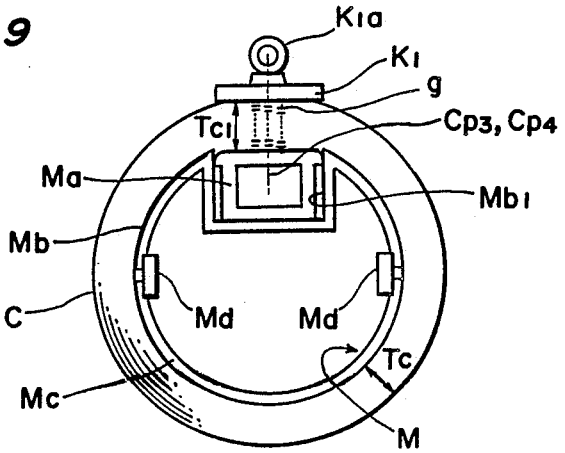
FIG. 9 is a front view of a core formed by winding all lamination blocks around the bobbin.

When all the lamination blocks B1 to $B_{30}$ have been wound, a plate-like press tool K1 is set on a portion of the outer periphery of the wound core corresponding to the shaping tool Ma so as to clamp the joint section of the core therebetween using a clamping means such as a squill or a bolt means, as shown schematically in FIG. 9. A chain line Cp3 (Cp4) shown in FIG. 9 indicates the center line of the clamp. The press tool Kl provides a hook Kla for hanging the core to move the same.

After clamping the joint section of the core between the shaping tool Ma and the press tool Kl, the bobbin M is disassembled into parts Mb, Mc and Md except for the shaping tool Ma. In order for that, connecting tools Md are removed therefrom by loosing bolts at first. When they are removed, respective gaps between the two semicircular members Mb and Mc are closed to allow the parts to draw out of the core C.

Figure 10:
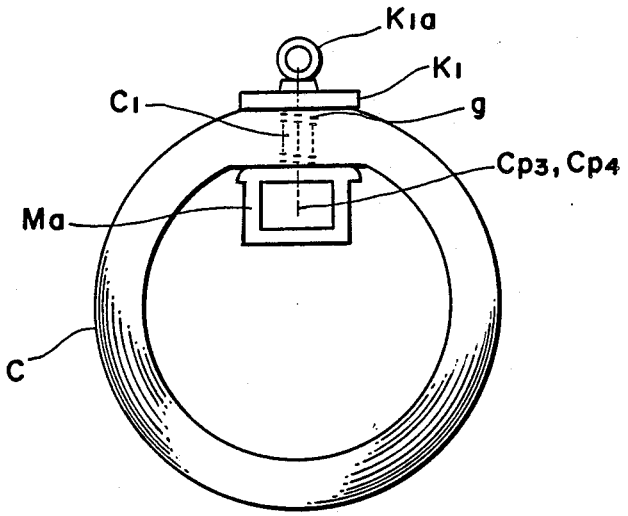
FIG. 10 is a front view showing the core after removing parts of the bobbin except for a shaping tool for the joint section thereof.

FIG. 10 shows this state.

Thereafter, the process for shaping the core into a rectangular configuration is performed. The rectangular of the core C has four sides C1, C2, C3 and C4 when seen in the anti-clockwise direction (the winding direction of the lamination block) The top and bottom sides C1 and C3 are called yoke portions and the left and right sides C2 and C4 are called leg portions around which wires are wound. The top side C1 includes the joint section of the core.

In the state shown in FIG. 10, the top side C1 has been formed and, accordingly, it is necessary to shape other three sides C2, C3 and C4 for forming a rectangular core.

Figure 11:
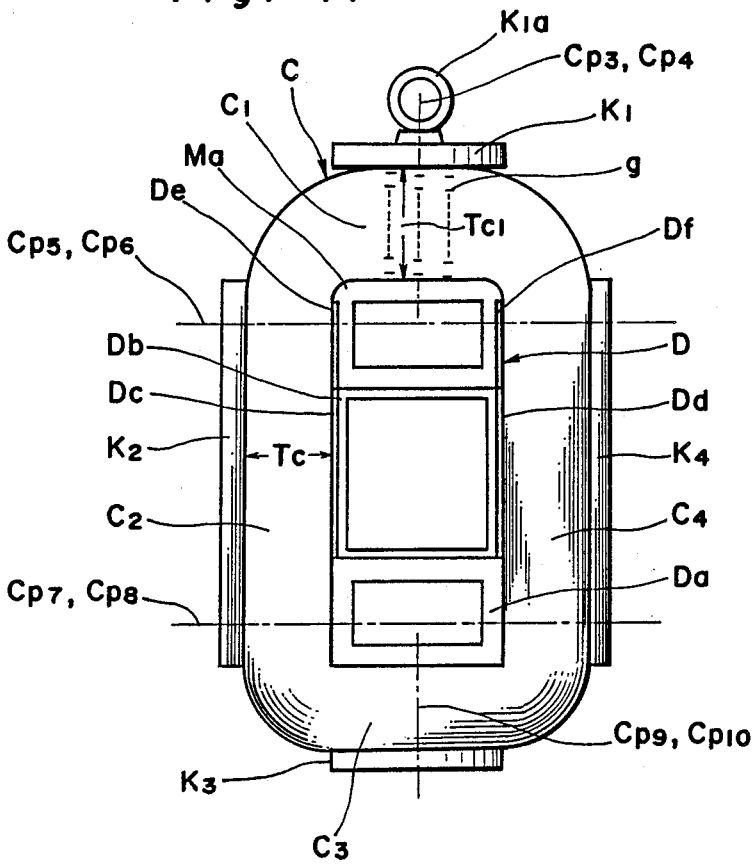
FIG. 11 is a front view of the core shaped into a rectangular configuration.

For that operation, there is provided a shaping tool D having a configuration such that it forms a configuration of the window of the rectangular core together with the shaping tool Ma, as shown in FIG. 11. In this example, the shaping tool D is comprised of five parts Da to Df. The part Da of a rectangular configuration is arranged to form the bottom side C3 oppositely to the shaping tool Ma and between the part Da and the shaping tool Ma, a square cylindrical part Db is arranged. Two plate-like parts Dc and Dd are inserted into respective gaps defined between the square cylindrical part Db and the core, respectively. Further, two plate-like parts De and Df are inserted into gaps defined between respective side wall of the shaping tool Ma and the core.

Since the shaping tool D is comprised of plural parts which can be easily disassembled, the insertion and disassembly of them can be made easily.

After shaping the inner periphery of the core by inserting the rectangular shaping tool D, plate-like press tools K2 to K3 are put on respective outer surfaces of the three sides C2 to C4 and, as indicated by chain lines Cp5, (Cp6), Cp7, (Cp8) and Cp9 (Cp10) in FIG. 11, the core is clamped, using suitable clamping means, between the press tools K2 and K4 and between the rectangular part Da and the press tool K3 in order to shape the outer periphery of the core. In FIG. 11, chain lines Cp3, Cp5, Cp7 and Cp9 having respective odd numbered suffixes indicate respective clamp positions on the front side of the core and alphanumerical reference signs Cp4, Cp6, Cp8 and Cp10 having respective even numbered suffixes indicate clamp positions on the rear side of the core.

In the present shaping method, the joint section of the core is kept in the clamped state and, therefore, individual joints are held as they are, during the shaping operation. This enables to manufacture cores of high quality without any defects of joints.

After shaping the core into a rectangular configuration, magnetic annealing of the core is performed to remove distortions having been caused in the core during the manufacturing process thereof and, thereby, the magnetic property thereof once lowered due to distortions is recovered desirably. In place of the magnetic annealing, a suitable thermal annealing can be done without applying any magnetic field.

Figure 12:
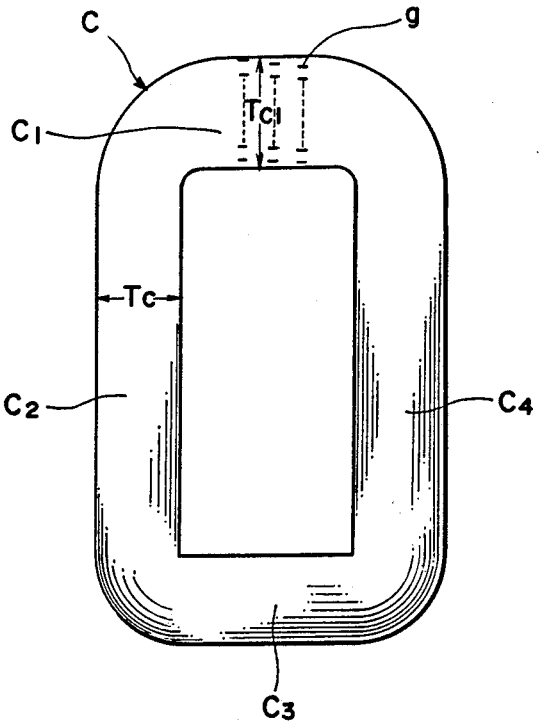
FIG. 12 is a front view of the core from which parts of the shaping tool have been removed after annealing.

After annealing the core, all parts of the shaping tools Ma and D are removed to obtain a bare core of a rectangular shape as shown in FIG. 12.

Thereafter, the yoke portion C3 and leg portions C2 and C4 of the core C are covered with suitable protection sheets such as insulation paper sheets (not shown) and the yoke portion C1 thereof is once opened to set windings around respective leg portions C2 and C4. After setting windings, the yoke portion C1 is again closed. The closed yoke portion C1 is covered with suitable protective sheets such as insulation paper sheets to obtain a complete core assembly.

Figure 13:
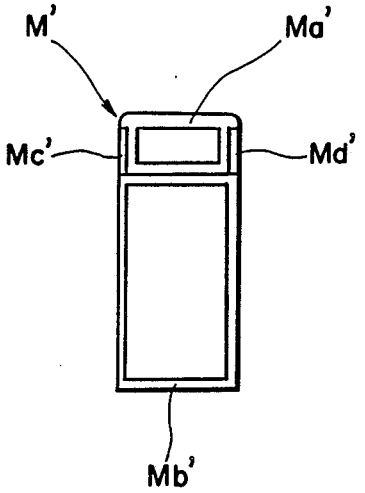
FIG. 13 is a front view of a bobbin of another type for winding lamination blocks therearound.

In the present preferred embodiment, the bobbin M of a substantially circular shape having a straight portion is used for winding lamination blocks, however, it is also possible to use a bobbin M, having a substantially rectangular shape as shown in FIG. 13. This bobbin M' is comprised of a shaping tool Ma' for shaping the joint section of the core which is similar to the shaping tool Ma, a tool Mb' of a rectangular frame structure and a pair of plate-like tool Mc' and Md' which are arranged along respective side walls of the shaping tool Ma' and, as a whole, has an out line same as that of the window of the core to be manufactured.

Figure 14:
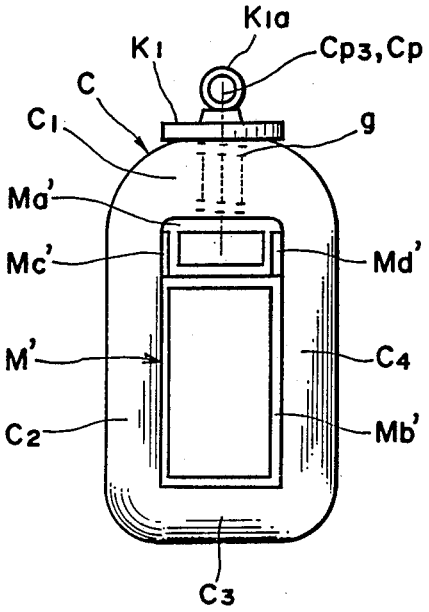
FIG. 14 is a front view of a core formed using the bobbin shown in FIG. 13.
Figure 15:
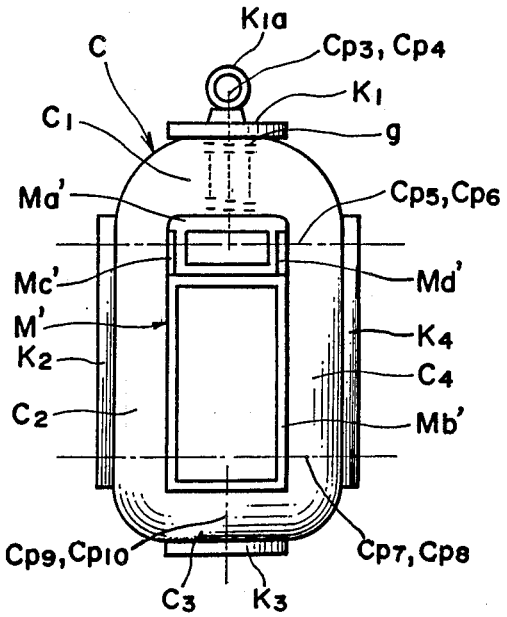
FIG. 15 is a front view of the core shaped using a shaping tool.

The manner for winding lamination blocks is substantially the same as that of the preferred embodiment. FIG. 14 corresponding to FIG. 9 shows a state wherein the winding operation of the lamination blocks has been completed. After the completion of winding the lamination blocks, as shown in FIG. 15, plate-like press tools K2 and K4 are put on respective outsides of the leg portions C2 and C4 and another plate-like press tool K3 is put on the outside of the yoke portion C3 in order to clamp respective portions C2, C3 and C4. Chain lines Cp3 to Cp10 shown in FIG. 15 indicate clamping positions. Annealing and assembling operation to be performed after shaping the core are substantially same as those of the foregoing preferred embodiment.

In the foregoing preferred embodiment, respective lamination blocks are formed after forming all of unit laminations and, after forming all of lamination blocks, the winding operation of them is performed. However, each of these operation, namely forming unit laminations, forming lamination blocks and winding them can be done parallel with each other.

Further, upon winding the lamination blocks, all the lamination blocks can be wound around the bobbin M' after stacking them in the developed state. In this case, respective lamination blocks each of which is formed by stacking lamination units from longer side are formed stacked one by one from longer side so as to coincide with each center of them. The stack thus formed is called the stack Sb of developed lamination blocks. Three lamination blocks B30 to B28 are only shown in FIG. 16, however, further lamination blocks from B27 to B1 are stacked one by one actually.

Figure 16:
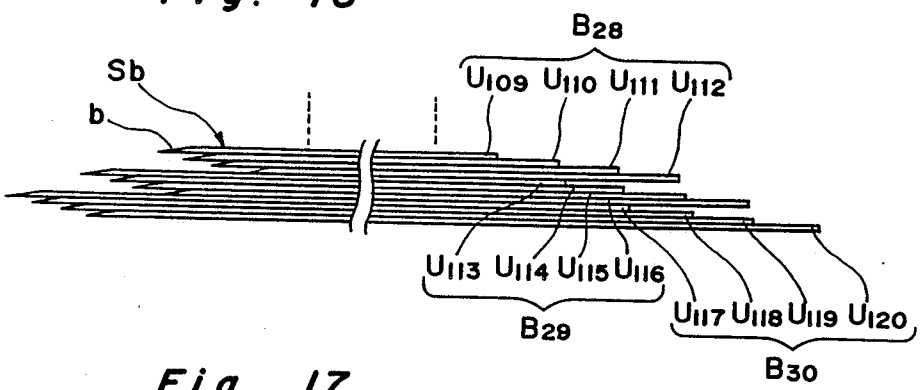
FIG. 16 is a partial front view of an assembled structure obtained by stacking all the developed lamination blocks.

As is apparent from FIG. 16, in the stack Sb of developed lamination blocks, all ends "a" of the stacked lamination units to which the adhesive agent is applied are arranged so as to locate at one side of the stack Sb and, accordingly, all free ends of them locate at another side of the stack. The plate-like press tool K3 is set beforehand at the center portion of the stack Sb though it is not shown in FIG. 16.

Figure 17:
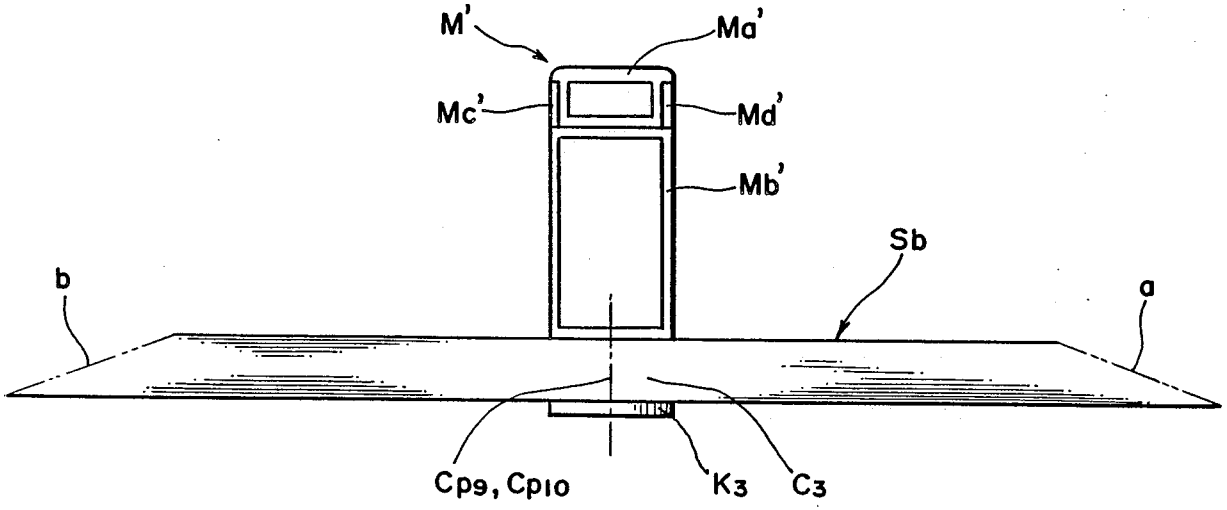
FIG. 17 is a front view of the assembled structure set for shaping using a shaping bobbin.

Then, as shown in FIG. 17, the bobbin M' is set on the shortest lamination unit of the lamination block B1 at the center position of the stack Sb and the center portion thereof between the bottom of the bobbin M' and the press tool K3 is clamped by clamping therebetween with suitable means such as bolts. Chain lines Cp9 and Cp10 show clamping positions which locate both sides of the stack Sb. The clamped portion C3 becomes the bottom yoke portion of the core when wound around the bobbin M'.

Thereafter, solvent such as ketone for resolving the adhesive agent having been applied to is sprayed or applied to respective ends of lamination units of the stack Sb in order to soften it.

Next, both of unclamped portions of the stack Sb are folded along both sides of the bobbin M' so as to form a U-shape using suitable pressing means such as press rollers and, thereby, the leg portions C2 and C4 of the core are formed.

Then, the leg portions C2 and C4 are clamped using plate-like press tools K2 and K4 and, thereafter, respective lamination units are jointed one by one from the inner side on the upper surface of the shaping tool Ma' to form the joint section C1. The joint section C1 thus formed is clamped in a manner as shown in FIG. 15.

According to this method, among respective strips forming each lamination unit, relative shifts are caused in the length-wise direction thereof upon folding the leg portions C2 and C4 and/or jointing the joint portion C1 since the center portion of the stack Sb corresponding to the yoke portion C3 of the core has been clamped beforehand. However, since the adhesive agent has been softened by the solvent, relative shifts among strips are caused smoothly without any extra resistive forces.

It is to be noted that both of taper angles of the cut ends "a" and "b" of each lamination unit do not become zero as far as this forming method concerns. In this case, they become $\tan^{-1}$ (about 72°) $\pi$ and both of ends "a" and "b" of each lamination unit oppose parallel but in a inclined state. Accordingly, the cross-section of the gap to be formed between adjacent lamination units becomes a parallelogram (See FIG. 18). However, this does not affect the magnetic characteristic of the core at all.

Figure 18:
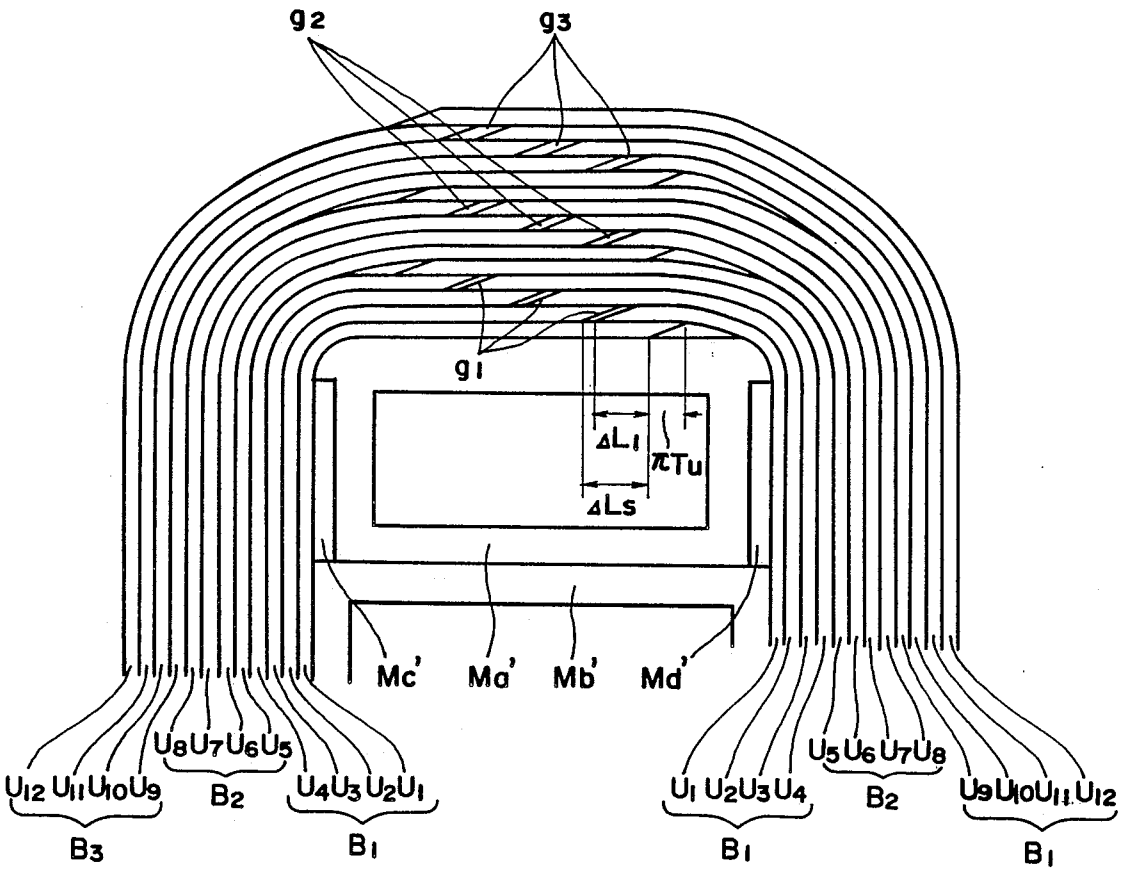
FIG. 18 is an enlarged partial view of the joint section of the lamination blocks wound around the shaping bobbin shown in FIG. 17.

FIG. 18 is an enlarged partial view of the joint section of the stack Sb wherein only three lamination blocks B1 to B3 are shown. According to this method, substantial lapping dimensions become longer than those obtained by the method shown in FIG. 8. The term "substantial lapping dimension" indicates the length of contact between both ends of two adjacent lamination units when seen in the lengthwise direction of the lamination unit.

As easily understood from FIG. 18, the substantial lapping dimension regarding the first lamination block B1 is given by $(\Delta L_1+\pi Tu)$ which is larger than that given in the case of FIG. 8. Namely, it increases by $\pi Tu$ when compared with the latter. This fact can be applied to other lamination blocks. In other words, the substantial lapping dimension equal to that of the latter can be obtained even if the standard shift length $\Delta Ls$ is decreased by $\pi Tu$ in the former case.

If the standard shift length Ls can be decreased, the number Nub of the lamination units per one lamination block B can be increased and, therefore, the lamination thickness $Tc_1$ of the joint section can be decreased without changing the length Lci of the inner periphery and the lamination thickness Tc of the core. In other words, the total volume of the strip can be decreased according to the present method.

In the present method, it is desirable in the application process of the adhesive agent to use such an adhesive agent having a weak cohesive power that maintains a cohesive power after application thereof and can be easily teared off without losing the adhesive power thereof. This serves to simplify necessary operation in the process. For example, "55 spray paste" ® made by the Sumitomo three M is effectively usable as the adhesive agent having a weak cohesive power. The adhesive agent of this type shows a weak adhesive power against a continuous external force but shows a relatively strong adhesive power against an instant external force. Accordingly, it is effective to careless handling of lamination units by workers since it can prevent them from unpackaging.

In the winding process of the lamination block, an external force is applied to the end faces for several seconds to which an adhesive agent has been applied. In the winding process according to the method shown in FIG. 8, the end faces should not be deformed by the external force but, according to the method shown in FIG. 18, they should be deformed by the external force easily. Since the adhesive agent having a weak cohesive power allows deformation of those and faces without applying solvent to the applied membrane, it guarantees smooth relative shifts among laminated strips during the winding process of the stack of the developed lamination blocks.

Next, a method for increasing the upper limit of the thickness of winding of the ring-like lamination is explained.

In order for that, to occur the thickness of winding of the ring-like lamination obtained by winding the strip around the circular bobbin Q is intended to become thicker than that of the lamination block wound around the bobbin M or M'. In other words the space factor of the ring-like lamination wound around the circular bobbin Q is made intentionally lower than that of the lamination block wound around the bobbin M or M'. The winding method of this kind is called "loose winding" and is distinguished from so called "normal winding" method wherein the thickness of winding of the ring-like lamination is made substantially equal to that of the wound lamination block as in the foregoing preferred embodiment.

In order for later consideration, space factors hm, hq and hq' are introduced. The space factor hm denotes the space factor of the lamination block wound around the winding bobbin M or M' and hq and hq' denote the space factors of the ring-like laminations wound around the circular bobbin Q according to the normal and the loose winding methods, respectively.

In the normal winding, $hq=hm$ and, more strictly, hq is substantially equal to hm. In the loose winding, $hq'<hm$.

Let us introduce a space factor ratio of the space factor of the lamination block wound around the winding bobbin M or M' to the space factor of the ring-like lamination wound around the circular bobbin. The space factor ratio hr denotes (hm / hq) and hr' denotes (hm / hq'). As is easily understood from the above, $hr=1$ (in the normal winding) and $hr'>1$ (in the loose winding).

Since it is necessary to wind the strip loosely in the loose winding by lowering the winding torque of the circular bobbin, it is difficult to prevent strips from shifting with each other. In order for that, it becomes necessary to employ proper means for preventing relative shifts among strips. When the strip is wound loosely by the member of turns same to that of the ring-like lamination wound according to the normal winding method, the thickness T' of the ring-like lamination R' is given by $hr' \cdot T$ ($T'=hr' \cdot T$) wherein T is the thickness of the ring-like lamination R wound according to the normal winding method. When the ring-like lamination R' is cut to form a developed lamination S', it has a lamination thickness equal to the lamination thickness T of the developed lamination formed from the developed lamination S. Accordingly, the length of a strip positioned at an arbitrary thickness $\gamma$ ($0 \leqq \gamma \leqq T$) in the developed lamination S' which is measured from the shortest strip thereof becomes larger than that of a strip at the same thickness in the developed lamination by an amount of $2\pi\gamma(hr'-1)$.

Further, considering taper angles $\theta a'$ and $\theta b'$ of the cut end faces a and b of the developed lamination S', the taper angle $\theta b'$ becomes larger than the taper angle $\theta b$ of the cut end face b of the developed lamination S although $\theta a'=\theta a=0$. This is due to the fact that $\theta b'=\tan^{-1}2\pi hr'>\tan^{-1}2\pi=\theta b=81°$. Accordingly, the lapping dimensions $\Delta L$ and $\Delta L'$ of j-th lamination units of the normal winding and the loose winding and the differences $\epsilon$ and $\epsilon'$ of the lapping dimension regarding the normal and loose windings satisfy the following relations, respectively;

$$\Delta L' > \Delta L$$

$$\epsilon' < \epsilon$$

Namely, the lapping dimension $\Delta L'$ regarding the loose winding is increased when compared with that regarding the normal winding and the difference $\epsilon'$ of the lapping dimension is decreased when compared with that the normal winding. Due to these facts, the upper limit of the thickness of the ring-like lamination can be increased substantially in the loose winding method.

It is to be noted that the thickness of the ring-like lamination wound loosely becomes large by hr' times when compared with that of the ring-like lamination wound normally. However, this increase of the thickness is only an appearance and the substantial lamination thickness is kept unchanged. Thus, the upper limit of the lamination thickness of the ring-like lamination obtained by the loose winding can be increased more than hr' times of that of the ring-like lamination obtained by the normal winding.

In order to study the loose winding method more particularly, let us introduce an upper limit of the number of the lamination blocks. This upper limit indicates the maximum number of the lamination blocks which is able to maintain the lapping dimension larger than or equal to the lower limit $\Delta L$min of the lapping dimension Nmax and N'max denote individual maximum numbers of the lamination blocks obtained in the normal and the loose winding methods (or a winding method of combination of the normal and the loose winding). In the loose winding method, the lapping dimensions of respective portions of the lamination block are not deemed constant and increase as they go to outer side.

Let us assume that the lapping dimension of j—th lamination unit of i—th lamination block is represented by $\Delta L'ij$ in the case of the loose winding.

With respect to the second lamination block B2, the following relations are satisfied;

$$\Delta L'2.1 < \Delta L'2.2 < \Delta L'2.3 < \Delta L'2.4$$

and $$\begin{aligned}\Delta L'2.4 - \Delta L'2.3 &= \Delta L'2.3 - \Delta L'2.2 \\ &= \Delta L'2.2 - \Delta L'2.1 \\ &= 2\pi Tu(hr' - 1)\end{aligned}$$

More, generally, with respect to the i—th lamination block Bi having m lamination units (Nub=m), individual lapping dimensions satisfy the following relation;

$$\begin{aligned}&\Delta L'i \cdot m - \Delta L'i \cdot (m-1) \\ &= \ldots = \Delta L'i \cdot 2 - \Delta L'i \cdot 1 \\ &= 2\pi Tu(hr' - 1) \qquad (13)\end{aligned}$$

$$\Delta L'i \cdot 1 = \Delta L'i \cdot m - 2\pi Tu(m-1)(hr' - 1) \text{ and also} \qquad (14)$$

$$\Delta L'(i+1) \cdot 1 = \Delta L'i \cdot m + 2\pi Tu(hr' - 1) - \epsilon \qquad (15)$$

Next, let us consider such a case that lamination blocks from first to (j—1)—th are formed according to the normal winding method and lamination blocks from j—th to the last are formed according to the loose winding method. In this case, the following equation is obtained replacing "i" in the equation (15) to "j";

$$\Delta L'(j+1)\cdot 1 = \Delta L'j\cdot m - \epsilon + 2\pi mTu\ (hr'-1) \qquad \ldots (16)$$

Since $\Delta L'j\cdot 1 = \Delta Lj$ and $mTu = Tb$, the equation (16) is rewritten as follows;

$$\begin{aligned}\Delta L'(j+1)\cdot 1 &= \Delta Lj - \epsilon + 2\pi Tb\ (hr'-1) \\ &= \Delta L(j+1) + 2\pi Tb(hr'-1) \qquad \ldots (17)\end{aligned}$$

Thus, in this case, the lapping dimension of the inner most lamination unit of the (j+1)-th lamination block which becomes smallest among lamination units of the lamination block becomes longer than that of the normal winding by $2\pi Tb\ (hr'-1)$.

In the normal winding, the lapping dimension of the lamination block of the upper limit Nmax is assumed to be given by the lower limit $\Delta L$min. If lamination blocks from J-th to the last (J<Nmax) are formed by the loose winding, the minimum value of the lapping dimension in the Nmax-th lamination block becomes to $\Delta L\min + 2\pi Tb(hr'-1)\ (Nmax-J)$. Accordingly, if $2\pi Tb(hr'-1)\times(Nmax=J)$ is larger than $\epsilon$, N'max can be made larger than Nmax.

Assuming that the lapping dimension of the (Nmax+x)-th lamination block becomes equal to the lower limit $\Delta L$min, the following equation is obtained;

$$2\pi Tb(hr'-1)\ (Nmax-J) = \epsilon x - 2\pi Tb\ x\ (hr'-1)$$

Accordingly, $$x = 2\pi Tb(hr'-1)\ (Nmax-J)\ /\ [\epsilon - 2\pi Tb(hr'-1)] \qquad \ldots (18)$$

Assuming that an integer given by [x] is represented by $\Delta N$, the following equation is satisfied (the symbol [] indicates the Gauss symbol), $$N'max = Nmax + \Delta N \qquad \ldots (19)$$

Next, the gap between the lamination units obtained by winding the lamination block according to the loose winding method is studied. The gap has a trapezoidal section being comprised of a pair of inner and outer surfaces parallel with each other, a cut end face perpendicular to the inner and outer surfaces on which an adhesive agent is applied and another cut end face inclined inwardly when seen in the radial direction of the wound lamination block. The length of the outer surface is shorter than that of the inner surface by $2\pi Tu(hr'-1)$.

Assuming that the lamination gaps of j—th lamination block are represented by $g'j\cdot 1, g'j\cdot 2, \ldots, g'j\cdot(m-1)$ in the order from the inner to the outer lamination units, each of them decreases by $2Tu(hr'-1)$ when compared with the inner one. The longest length $\Delta L'gjmax$ among these lamination gaps is that of the inner surface of the inner most gap $g'j\cdot 1$ and the shortest length $\Delta L'gjmin$ is that of the outer surface of the outer most gap $g'j\cdot(m-1)$. The difference $(\Delta L'gjmax-\Delta L'gjmin)$ between them is given by $2\pi Tu\ (m-1)\ (hr'-1)$. The relation regarding lamination gaps is similarly applied to gaps of each of lamination blocks from $(J+1)$ - th to the last.

In the above example, the lamination blocks from $J-$th to the last are formed by the loose winding, but, if $J=1$, all of the lamination blocks are formed by the loose winding.

Next, such a condition that N'max may not be restricted further will be considered.

If $\Delta L'(j+1)\cdot 1$ given by the equation (16) can be set equal to $\Delta L'j\cdot 1$, the lapping dimension can be kept unchanged even if N'max is increased infinitely.

Utilizing the equation (16), the space factor hr' therefore is given by the following equation;

$$hr'=1+\epsilon\ /\ (2\pi Tb) \qquad \ldots (20)$$

wherein $Tb=mTu$

Assuming that $\epsilon=0.9$ mms and $Tb=4$ mms, $hr'=1.036$.

In a theoretical view point, it seems desirable to wind the strip loosely so as to yield the space factor given by the equation (20).

However, the following inconveniences are caused when the strip is wound loosely from the first lamination block B1.

As stated above, the minimum gap of a lamination block becomes smaller than the maximum gap of the same by $2\pi Tu(m-1)\ (hr'-1)$. The gap of the first lamination block B1 by the normal winding is $0.5\ \epsilon$ according to the equation (12). The maximum gap $\Delta L'glmax$ of the first lamination block B1 by the loose winding is also $0.5\epsilon$. In this case, the minimum gap $\Delta L'glmin$ is given by the following equation;

$$\Delta L'glmin=0.5\epsilon-2\pi Tu\ (m-1)(hr'-1)$$

Substituting the relation given by the equation (20) into this equation, the next equation is obtained;

$$\Delta L'glmin=\epsilon(2-m)\ /\ (2m).$$

If $m\geqq 3$, $\Delta L'glmin$ becomes negative. This indicates that the gap is diminished and, therefore, both cut ends of a lamination unit are overlapped with each other.

However, this inconvenience can be avoided by starting the loose winding from the second lamination block.

Figure 19:
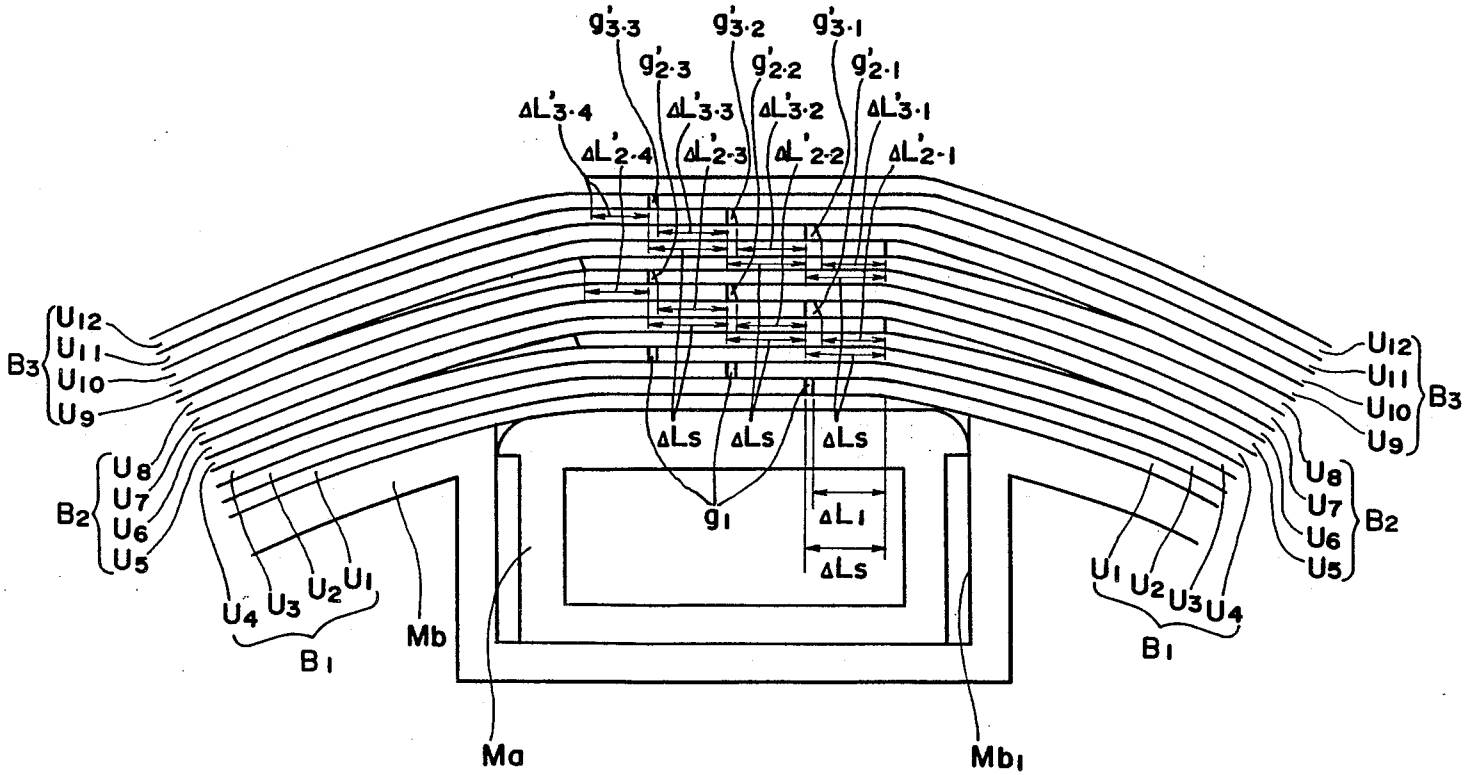
FIG. 19 is an enlarged partial view of a joint section of lamination blocks obtained from ring-like laminations having been wound tightly and loosely.

FIG. 19 shows a joint section of a core with respect to the first to third lamination blocks B1 to B3 wherein the first one is wound normally and others are wound loosely according to the condition given by the equation (20).

In FIG. 19, lamination gaps are given as follows;

$$\Delta Lg1 = 0.5\epsilon$$

$$\Delta L'g2max = \Delta L'g3max = \ldots = 1.5\epsilon$$

$$\Delta L'g2min = \Delta L'g3min = \ldots = 0.75\epsilon$$

Also, the lapping dimensions are given as follows;

$$\Delta L1 = \Delta Ls - 0.5\epsilon$$

-continued $$\Delta L'2.1 = \Delta L'3.1 = \ldots = \Delta Ls - 1.5\epsilon$$

$$\Delta L'2.2 = \Delta L'3.2 = \ldots = \Delta Ls - 1.25\epsilon$$

$$\Delta L'2.3 = \Delta L'3.3 = \ldots = \Delta Ls - \epsilon$$

$$\Delta L'2.4 = \Delta L'3.4 = \ldots = \Delta Ls - 0.75\epsilon$$

Accordingly, the standard shift dimension $\Delta Ls$ is given from the theoretical consideration as follows;

$$\Delta Ls=\Delta Lmin+1.5\epsilon \qquad \ldots (21)$$

assuming that $\Delta Lmin=6$ mms, $\epsilon=0.9$ mms, $\Delta Ls=7.4$ mms. This is about one half of the standard shift dimension (15 mms) which should be set in the case of the normal winding.

It is to be noted that the above values are given only from the theoretical consideration. In other words, the standard shift dimension should be set concidering various view points such as actual lapping states of individual lamination units, easiness in the lapping operation and the like. Anyway, it is understood that the loose winding contributes to decrease the standard shift dimension effectively.

The loose winding method is not limited to the case of FIG. 19. Generally speaking, if the loose winding is started from y-th lamination block ($y\geqq 2$), the standard shift dimension $\Delta Ls$ is given by the following equation;

$$\Delta Ls=\Delta Lmin+(y-0.5)\ \epsilon \qquad \ldots (22)$$

In the loose winding method, it may not be so easy to control the space factor h'r given by the equation (22) strictly. Taking this into consideration, it is actual to set y at 3 or 4 and to set $\Delta Ls$ at a value slightly larger than the value given by the equation (22). For instance, it is desirable to set the standard shift dimension larger than $\Delta Ls$ by 2 or 3 mms in order to make the winding operation easier.

Thus, according to the loose winding method, the standard shift dimension can be decreased effectively and this contributes to increase the number of lamination units per one lamination block. Accordingly, the lamination thickness Tc1 of the lapping section of the core can be decreased when compared with that of the core having the same inner peripheral length Lci and the lamination thickness Tc and, therefore, the volume of the strip needed for forming the core can be decreased.

In order for the loose winding, it is also possible to wind a spacer together with the strip every constant winding thickness. In this case, an iron strip having the same dimensions as those of the amorphous strip. It is wound 1 by one or a several turns at one time. These spacers are removed upon forming lamination units from individual developed laminations S. If the iron strip is wound by several turns, the amorphous strips put between the iron strips are removed together with the latter.

It is to be noted that the present invention is applicable to cores each of which has it's lapping joint section at a leg portion thereof.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A method for manufacturing rectangular wound cores comprising the following steps:

winding a strip of an amorphous magnetic alloy around a substantially circular bobbin to form at least one ring-like lamination body, and cutting the ring-like lamination body in a radial direction to form at least one developed lamination body having two cut ends;

applying adhesive agent to one cut end of said at least one developed lamination body;

separating said at least one developed lamination body into a plurality of lamination units, and shifting the lamination units relative to each other in a lengthwise direction by a predetermined distance to form a plurality of lamination blocks of different lengths; and jointing both ends of each of said lamination units of each of said plurality of lamination blocks in an overlapped state by winding each lamination block around a shaping bobbin for shaping said plural lamination blocks to form a substantially rectangular wound core, said step of winding including winding the lamination blocks around the shaping bobbin in the order from the shortest lamination block to the longest lamination block and wherein each of said plurality of lamination blocks is wound starting from the cut end to which adhesive agent has been applied.

2. The method as claimed in claim 1, in which first to n−th, wherein n is an integer larger than 1, developed lamination bodies are formed from first to n−th ring-like lamination bodies having diameters which increase stepwise.

3. The method as claimed in claim 2, wherein said first to n-th ring-like lamination bodies are formed by winding strips of amorphous magnetic alloy around first to n−th substantially circular bobbins, and the i−th circular bobbin, wherein i is an integer of 2 to n, has a diameter larger than the outer diameter of the (i−1)−th ring-like lamination block by a predetermined length.

4. The method as claimed in claim 1, wherein said substantially circular bobbin has a flat portion along the outer periphery thereof which corresponds to a shorter side of a substantially rectangular window defined by the inner periphery of said substantially rectangular wound core.

5. The method as claimed in claim 4, wherein said lamination units are jointed in said overlapped state on said flat portion of said shaping bobbin.

6. The method as claimed in claim 4, wherein said bobbin for shaping said plural lamination blocks has a rectangular configuration substantially the same as the outer configuration of said window of said wound core, and said lamination units are jointed in an overlapped state on one of the shorter sides of said shaping bobbin.

7. The method as claimed in claim 6, wherein said plurality of developed lamination blocks are stacked successively in the order from the longest lamination block to the shortest lamination block to form a stacked lamination body in which the center positions of the lamination blocks coincide with each other and the center portion of said stacked lamination body is fixed at one of the shorter sides of said shaping bobbin and, thereafter, are wound around said shaping bobbin to joint respective lamination unit son the other shorter side of said shaping bobbin.

8. The method as claimed in claim 7, wherein the applied adhesive agent is softened before winding said stacked lamination body around said shaping bobbin.

9. The method as claimed in claim 1, wherein said ring-like lamination body is formed to have a space factor smaller than that of the wound core being manufactured.

* * * * *

UNITED STATES PATENT AND TRADEMARK OFFICE

CERTIFICATE OF CORRECTION

PATENT NO. : 4,972,573

DATED : November 27, 1990

INVENTOR(S) : Yasuo Yamamoto, et al.

It is certified that error appears in the above-identified patent and that said Letters Patent is hereby corrected as shown below:

Column 1, line 35: "to winding" should read as --to bit winding--

Column 1, line 47: "element" should read as --elements--

Column 1, line 67: delete "it"

Column 2, line 19: "lapped a" should read as --lapped with a--

Column 2, line 49: "transformed" should read as --transformer--

Column 3, line 13: "form" should read as --from--

Column 3, line 27: "ringlike" should read as --ring-like--

Column 3, lines 47 & 49: "," should read as --;--

Column 5, line 8: "ringlike" should read as --ring-like--

Column 5, line 44: "(1)" should read as --····(1)--

Column 5, line 45: "(2)" should read as --····(2)--

Column 5, line 46: "(3)" should read as --····(3)--

Column 5, line 63: "thicknes" should read as --thickness--

UNITED STATES PATENT AND TRADEMARK OFFICE

CERTIFICATE OF CORRECTION

PATENT NO. : 4,972,573

DATED : November 27, 1990

INVENTOR(S) : Yasuo Yamamoto, et al.

It is certified that error appears in the above-identified patent and that said Letters Patent is hereby corrected as shown below:

Column 10, line 40: "(5)" should read as --·····(5)--

Column 10, line 46: after "other" add --difference--

Column 10, line 55: "(6)" should read as --·····(6)--

Column 11, line 25: "(7)" should read as --·····(7)--

Column 11, line 31: "9 ·0.9)" should read as --9 * 0.9)--

Column 11, line 51: "(8)" should read as --·····(8)--

Column 12, line 3: " · $\varepsilon/\pi$ ··" should read as -- * $\varepsilon/\pi$ --

Column 12, line 4: "10 ·0.9" should read as --10 * 0.9--

Column 12, line 26: "10 · 3" should read as --10 * 3--

Column 12, line 28: "Tu · Nb" should read as --Tu * Nb--

Column 13, line 6: "block)" should read as --block).--

Column 14, lines 5 & 8: "M" should read as --M'--

Column 14, line 15: "out line" should read as --outline--

UNITED STATES PATENT AND TRADEMARK OFFICE

CERTIFICATE OF CORRECTION

PATENT NO. : 4,972,573

DATED : November 27, 1990

INVENTOR(S) : Yasuo Yamamoto, et al.

It is certified that error appears in the above-identified patent and that said Letters Patent is hereby corrected as shown below:

Column 16, line 62: " ·T (T'=hr'·T)" should read as --* T (T' + hr'* T)--

Column 17, lines 32 & 39: "hr," should read as --hr'--

Column 18, line 9: "(13)" should read as -----(13)---

Column 18, line 10: "(140" should read as -----(14)--

Column 18, line 39: "(Nmax+J)" should read as --(Nmas - J)--

Column 20, line 20: concidering" should read as --considering--

Column 20, line 62: "it's" should read as --its--

Column 22, line 33, Claim 7: "unit son" should read as --units on--

Signed and Sealed this

Fourteenth Day of July, 1992

*Attest:*

DOUGLAS B. COMER

*Attesting Officer*

*Acting Commissioner of Patents and Trademarks*